United States Patent [19]

Garner

[11] Patent Number: 4,590,755

[45] Date of Patent: May 27, 1986

[54] LOW FATIGUE APPARATUS FOR STRANDING WIRE

[75] Inventor: John N. Garner, Kingston, Canada

[73] Assignee: Northern Telecom Limited, Montreal, Canada

[21] Appl. No.: 710,349

[22] Filed: Mar. 11, 1985

[51] Int. Cl.[4] ..... H01B 13/04

[52] U.S. Cl. ..... 57/293; 57/332; 57/344

[58] Field of Search ..... 57/293, 294, 3, 6, 9, 57/314, 332, 341–349

[56] References Cited

U.S. PATENT DOCUMENTS

| | | | |
|---|---|---|---|
| 3,847,190 | 11/1974 | Forester | 57/293 X |
| 3,910,022 | 10/1975 | Reed | 57/293 |
| 4,325,214 | 4/1982 | Zuber | 57/344 X |
| 4,414,802 | 11/1983 | Garner et al. | 57/332 X |
| 4,426,838 | 1/1984 | Garner et al. | 57/293 |
| 4,426,839 | 1/1984 | Garner et al. | 57/293 |
| 4,429,520 | 2/1984 | Garner et al. | 57/293 |

*Primary Examiner*—John Petrakes

*Attorney, Agent, or Firm*—R. J. Austin

[57] ABSTRACT

A tube for use in apparatus for twisting wires together such as that described in U.S. Pat. No. 4,429,520. The tube has an outer layer of one material and a thinner inner layer of another material which is bonded to the outer layer. There are at least two feedpaths for the wires and the inner layer surrounds each of two passages defining these feedpaths. The inner layer is abrasion resistant and is less deformable and more rigid than the outer layer while the flexibility of the tube enables it to be rotationally flexed about a longitudinal axis to torsionally twist it alternately in opposite directions.

5 Claims, 4 Drawing Figures

LOW FATIGUE APPARATUS FOR STRANDING WIRE

This invention relates to apparatus for stranding wires.

It is known that the stranding of wires together offers physical and electrical advantages when the wires are individually insulated conductors as used in communications or other electrical systems. For example, the stranding of pairs of wires as used in telephone systems improves electrical characteristics such as reducing crosstalk.

Conventionally, to continuously strand wires together in the same direction requires a heavy rotatable construction as the wire spools for feeding wire into the apparatus must also revolve about the machine axis. The excessive weight of the construction limits the operational speed. In order to avoid the rotation of the spools, a periodically reversing stranding operation is performed upon the wires and, as it is desirable to strand long lengths of wires in each direction, accumulators become necessary.

In order to overcome problems with known stranding apparatus, simpler apparatus has been devised to give a periodic reverse stranding operation. This simpler apparatus, as described in U.S. Pat. No. 3,910,022 granted Oct. 7, 1975 in the name of Phillip John Reed and entitled "Apparatus for Stranding Wires" involves the use of a tubular member, one end of which is held stationary and the other torsionally twisted first in one direction and then in the other around its longitudinal axis. Dividers positioned along the member divide the tube passage into separate paths for wires passing down the member. A twisting means at the downstream end of the tubular member twists the member by rotating the downstream end of the member for a predetermined number of revolutions, first in one direction and then in the other, to torsionally twist the member in reversing manner. A twist is imposed upon each wire by the twisting means and this twist causes the wires to strand together along their lengths as the wires emerge from the twisting means.

In U.S. Pat. No. 4,325,214 granted Apr. 20, 1982, in the name of Bretislav Paval Zuber and entitled "Apparatus For Stranding Wire", there is described an improvement to the Reed construction. In this patent, the tubular member is replaced by an elongate member which is held stationary at an upstream end and is rotatable at the downstream end for twisting it. The member has a plurality of wire guiding elements extending radially outwards from it, each element having wire guiding holes whereby the wires are threaded through the holes from guiding element to guiding element while being located outwards from the elongate member. While the operation of the apparatus described in the above patents is satisfactory, it has been found that there is a drag created upon the wires as they pass along their feedpaths and this drag affects the speed of throughput of the wire. This drag is created by the contact by the wires with the spaced-apart wire guiding elements or the dividers, as the case may be.

As an improvement on the apparatus described in the above patents, U.S. Pat. No. 4,429,520 filed Feb. 7, 1974, in the names of J. N. Garner and J. M. Roberge for "Apparatus For Stranding At Least Two Wires Together" concerns apparatus for stranding wires together in which provision is made for movement of the wires along a section of path which follows a fixed curve. This apparatus as described in the latter patent enables a plurality of units of wires to be twisted together and then these units to be stranded together in the form of a core unit.

Two further patents deal with a tubular means defining a passage for wires to be twisted into a unit and for use in the apparatus described in U.S. Pat. No. 4,429,520. One of these patents, namely U.S. Pat. No. 4,414,802, granted Nov. 15, 1983 and entitled "Apparatus For Stranding Wire" in the names of J. N. Garner, J. M. Roberge and D. G. Baxter, is concerned with apparatus having a single tube defining a single axial passage for at least two side-by-side feedpaths for the wire. The other patent, U.S. Pat. No. 4,426,839, granted Jan. 24, 1984 for an invention entitled "Stranding Wires" in the names of J. N. Garner and J. M. Roberge, describes an apparatus having two tubes each for guiding a wire, the tubes being twisted around one another alternately in one direction and then the other. A problem with the tubes or tubular means described in the aforementioned patents is that they have been formed of material which while being abrasion resistant to resist wear during passage of conductors through them, have also been necessarily of rigid materials such as acetyl-copolymers or stainless steel. These materials have provided the tubular means with sufficient strength to resist extension during the twisting operation which would obviously be undesirable. However, a problem which does exist is that because of the choice of these materials, the tubular means do not have a desirably long life but tend to fatigue after moderate periods of use thereby rendering them useless.

The present invention provides a tubular means for guiding wires for use in apparatus for twisting wires together in which the structure of the tubular means increases their useful life beyond that found with the previous construction.

Accordingly, the present invention provides a tubular means for use in apparatus for twisting wires together and providing at least two feedpaths for the wires by defining at least one passage along the tubular means, the tubular means comprising an outer layer of a first material and an inner and thinner layer of a second material surrounding the or each passage, two layers bonded together with the characteristics of the materials such that the inner layer is abrasion resistant and is less deformable and more rigid than the outer layer while the flexibility of the structure enables the tubular means to be rotationally flexed about a longitudinal axis to torsionally twist the tubular means alternately in one direction and then in the other while causing the feedpaths to follow a helical path around said axis.

With the construction according to the invention, the inner layer may be thinner than has previously been possible and is provided for its abrasion resistant properties when in contact with the wire moving along its feedpath. The inner layer also provides a degree of rigidity to the structure and offers resistance to extension of the tubular means during its oscillating twisting action. On the other hand the outer layer while being more plastic than the inner layer can withstand large amounts of movement without fracture while providing sufficient mechanical strength to support the tube over the required distances in the apparatus.

Embodiments of the invention will now be described by way of example, with reference to the accompanying drawings in which.

Figure 1:
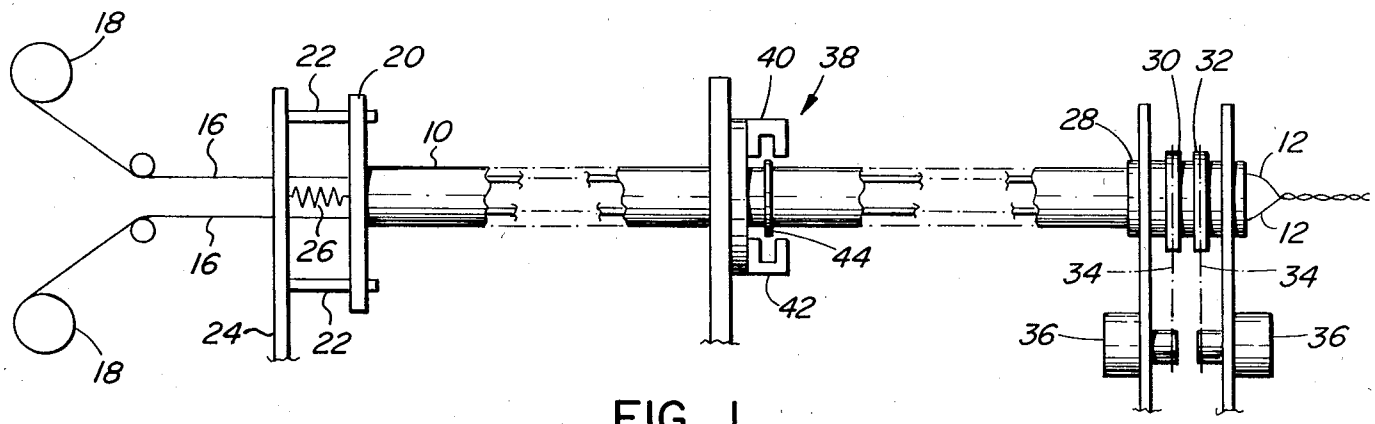
FIG. 1 is a side elevational view, partly in cross-section, of apparatus according to a first embodiment.
Figure 2:
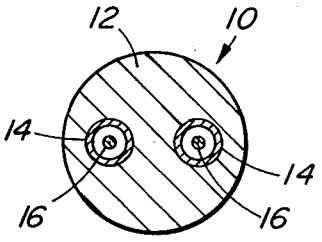
FIG. 2 is a cross-sectional view taken along line II—II in FIG. 1 and on a larger scale.

The apparatus shown in FIGS. 1 and 2 comprises a tubular means 10 of composite construction which is shown more specifically by FIG. 2. The tubular means 10 comprises an outer layer 12 of plasticized polyvinylchloride embedded within which are two substantially parallel spaced-apart tubes 14 which form inner layers and are made from a polyvinylchloride composition which is more rigid than the layer 12. Each of the tubes 14 surrounds a feedpath for an insulated wire or conductor 16, the wires to be twisted together after passage through the tubes as will be described.

The tubular means 10 forms part of an apparatus to extend along the feedpaths for the two wires 16 which are to be fed from spools 18. The tubular means is held at its upstream end by a holding means to hold it against rotation. This holding means comprises a tube support plate 20 which carries the upstream end of the tubular means 10 in a complementary hole formed within the plate. The plate 20 is slidably received in the axial direction of the tube upon two parallel guides 22 which are mounted in an upstream position to a fixed frame member 24. By this means, the plate 20 is movable in the axial direction of the tubular member. The plate is resiliently urged towards the frame 24 by means of two tension springs 26 extending between the plate and the frame as shown in FIG. 1. The springs 26 are superposed one upon the other in FIG. 1, whereby only one spring is shown.

At the downstream end of the tubular means 10, a twisting means is provided for twisting the means 10 alternately in one direction and then in the other about a longitudinal axis which lies substantially centrally of the cross-sectional tube shape in FIG. 2. This twisting means comprises a cylinder 28 with a hole formed to securely receive the downstream end of the tube. Two annular electric clutches 30 and 32 have their driven sides secured to the cylinder for driving the cylinder alternately in opposite directions. Each clutch is drivable by a drive belt 34 continuously driven by an electric motor 36 which forms a rotating means for rotating the cylinder 28. Upon rotation of one clutch or the other, the cylinder is rotated in one direction thereby carrying the downstream end of the tubular member with it and around the axis of the tubular member. As the upstream end of the tubular means is non-rotatable, then any rotation of the downstream end imposes a twist upon the tubular means. Alternately, if the other clutch is operated, then the rotation of the downstream end of the tubular member and thus the twist, is in the opposite direction. The operation of the clutches and motors is such that the downstream end of the tubular means is rotated first in one direction about its equilibrium untwisted position and then in the opposite direction. The design and material of the tubular member are such that it is at least capable of completing 35 revolutions in each direction from its equilibrium position for a satisfactory working period without failure.

A direction changing means 38 is provided and this is located at a short distance downstream from the upstream end of the tubular means as shown in FIG. 1, i.e. at a position in which the tubular means rotates less than 360° around its axis for the maximum amount of turns, i.e. 70 turns at the downstream end of the tube. This direction changing means is, in fact, located at a position in which the tubular means turns only 90° in each direction for the 35 rotations at its downstream end at each side of the equilibrium position in FIG. 1. This direction changing means is of similar construction to that described in U.S. Pat. No. 4,426,838, entitled "Apparatus For Stranding Wires" in the names of J. N. Garner, J. M. Roberge and N. Meilenner. As described in the latter mentioned patent, the direction changing means comprises two U-shaped heads 40 and 42 each carrying a magnet in one leg of the U for creating an electric field and inducing an electric current into a coil in the other leg. Each coil sends signals into an electric circuit (not shown), the strength of the signals dependent upon the strength of the magnetic field. The changing means also comprises a trigger device for interrupting the magnetic field around each magnet and this trigger device comprises an interrupter arm 44 shown in FIG. 1. The interrupter arm is securely attached to the tubular means 10 so as to be rotated by it. During oscillation of the tubular means the interrupter arm rotates from a position within the U of one of the heads 40 and 42 to a position within the other head. As described in the aforementioned U.S. Pat. No. 4,426,838 the interrupter arm when reaching one of these positions while the tubular means being twisted in one direction around its axis, causes the electric circuit to operate the appropriate clutch 36 to commence rotation and twisting of the tubular means in the opposite direction.

Hence, in use the tubular means 10 is rotated for a number of revolutions at its downstream end first in one direction and then the other while the upstream end is held rotationally stationary. The total mechanical strength of the inner and outer layers of material is such as to support the weight of the tubular member as it is held by its ends in the apparatus. The bonding of the inner layer to the outer layer provides a composite construction which adds to the mechanical strength. The inner layer in being more rigid than the outer layer provides a degree of control on the twisting operation and follows precisely the operation of the clutch mechanisms for providing the twist. If, however, the inner layer were not provided then the outer layer material could possibly twist in uncontrollable fashion throughout its length during twisting and reversal of twist from one limit position to the other. In addition to this, should the inner layer fatigue during use by cracking or splitting of the layer, then its bond to the outer layer retains the tubular member in its composite construction with the outer layer holding the parts of the inner layer in position. The strength of the tubular member is thus retained throughout its length apart from the fatigued region. The material of the outer layer ensures that the outer layer will withstand far greater periods of use without fracturing under fatigue.

In the above embodiment, the materials quoted are based on polyvinylchloride compositions. However, the inner layer may alternatively be an acetyl homopolymer such as "Delrin" which is bonded to the outer layer, or may even be of stainless steel.

Figure 4:
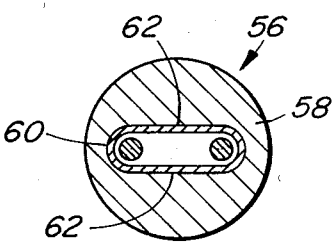
FIGS. 3 and 4 are views similar to FIG. 2 of second and third embodiments.
Figure 3:
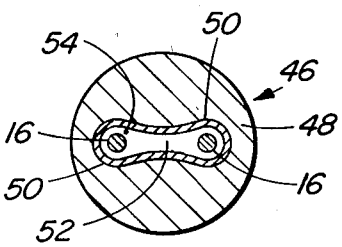

The embodiments shown in FIGS. 3 and 4 differ only in that the constructions have a single inner layer as compared to two layers in the first embodiment and the shapes of these two layers in FIGS. 3 and 4 are different one from another.

As shown in FIG. 3, a tubular means 46 has an outer layer 48 of similar construction to that described in the first embodiment and a single inner layer 50 which, in cross-section, is generally of a figure-eight shape. Thus the inner layer 50 is wider at each side than along the center where there is a restriction 52 in the width of the passage. Each side 54 of the passage provides a feedpath for an insulated electrical conductor or wire 16. The inner layer is formed from two part-circular, arcuately formed, longitudinally extending strips of the material and these strips have been joined along their center line in any suitable manner such as by plastics joining methods. As an alternative to this, the figure-eight construction of the inner layer 50 is formed as a single integral extrusion.

Hence the inner layer 50 provides a single inner layer which surrounds a single passage defining two feedpaths for two insulated conductors or wires. Upon twisting movement of the tubular means in a manner similar to that described in the first embodiment the conductors are twisted so as to strand them together after leaving the tubular means in the manner shown in FIG. 1. The restriction 52 in the passage prevents the conductors twisting together or even contacting each other until after they have emerged from the tubular member.

In a third embodiment as shown in FIG. 4, a tubular means 56 comprises an outer layer 58 with an inner layer 60 which is similarly constructed to the inner layer except that no restriction is formed between the two ends of the tube. The tube 60 may be formed after extrusion of a substantially circular cross-section tube by passing it through a flattening apparatus to provide two substantially flat and parallel portions 62. In other words, the tube 60 has a widened elongate passage in cross-section and this passage is of sufficient width to accommodate a predetermined outside diameter of insulated conductor while providing sufficient clearance to enable it to pass through the tube. This passage will not allow two insulated conductors to interchange their positions so long as the conductors are of a suitable size to pass through the passage as has just been discussed. In a preferred arrangement with a construction of this type and to prevent the wires or conductors from becoming jammed within the passage, it would be sufficient for the passage to provide a sufficient clearance around each wire for free running along its feedpath.

I claim:

1. A tubular means for use in apparatus for twisting wires together and providing at least two feedpaths for the wires by defining at least one passage along the tubular means, the means comprising an outer layer of a first material and an inner and thinner layer of a second material surrounding the or each passage, the two layers bonded together with the characteristics of the materials such that the inner layer is abrasion resistant and is less deformable and more rigid than the outer layer while the flexibility of the structure enables the tubular means to be rotationally flexed about a longitudinal axis to torsionally twist the tubular means alternately in one direction and then in the other while causing the feedpaths to follow a helical path around said axis.

2. A tubular means according to claim 1 provided with two inner layers each surrounding a single passage defining a single feedpath, the two inner layers extending along the length of the tubular means.

3. A tubular means according to claim 1 including a single inner layer which surrounds a single passage which defines at least two feedpaths for two wires.

4. A tubular means according to claim 1 wherein the outer layer is formed from a plasticized polyvinylchloride composition and the inner layer is formed from a more rigid polyvinylchloride composition.

5. A tubular means according to claim 1 wherein the outer layer is formed from a plasticized polyvinylchloride composition and the inner layer is formed from an acetyl homopolymer.

* * * * *